United States Patent [19]

Poole

[11] 4,047,848

[45] Sept. 13, 1977

[54] CENTRIFUGAL COMPRESSORS

[75] Inventor: Eric John Poole, Wendover, England

[73] Assignee: Compair Industrial Limited, England

[21] Appl. No.: 542,814

[22] Filed: Jan. 21, 1975

[30] Foreign Application Priority Data

Jan. 31, 1974 United Kingdom ..... 4604/74

[51] Int. Cl.[2] ..... F04B 35/04

[52] U.S. Cl. ..... 417/374; 74/665 A; 415/122 R

[58] Field of Search ..... 415/122 R; 417/374; 74/665 A, 665 B, 665 N, 665 L

[56] References Cited

U.S. PATENT DOCUMENTS

| | | | |
|---|---|---|---|
| 2,366,732 | 1/1945 | Kalix | 415/121 R |
| 3,145,579 | 8/1964 | Fleming | 74/665 B |
| 3,214,990 | 11/1965 | Jekat | 415/122 R |
| 3,802,795 | 4/1974 | Nyeste | 415/122 R |
| 3,809,493 | 5/1974 | Pilarczyk | 415/122 R |
| 3,824,875 | 7/1974 | Willert et al. | 74/665 N |

*Primary Examiner*—Henry F. Raduazo

*Attorney, Agent, or Firm*—Mawhinney, Mawhinney & Connors

[57] ABSTRACT

A centrifugal compressor has at least one stage with its own impeller shaft and a gear train for driving the impeller shaft. The gear train includes a plurality of meshing parallel shaft gears comprising two input gears either of which can receive drive from a prime mover. The ratio of the number of teeth of the input gears is such that the relative shaft speeds of the input gears are 5n: 6N where *n* is 1 or 2 and N is 1 or 2.

4 Claims, 3 Drawing Figures

47
49
25
44
52
21
57
33b
45
26
24
43
56
54
51
50
56
51
27
53
19
28
20
48
46
22
55
32
12
14

CENTRIFUGAL COMPRESSORS

BACKGROUND OF THE INVENTION

1. Field of the Invention.

The invention relates to centrifugal compressors.

2. Prior Art

A well-known arrangement of integrally geared multi-stage centrifugal compressors is the bull gear arrangement in which the impeller shafts are parallel to one another and have respective gears mounted thereon which mesh with a central driving gear at spaced locations around the periphery of the driving gear. In such arrangements the gearing between the central driving gear and the individual impeller shafts is selected to step up the output speed of standard 2-pole 60 hz motors which rotate at 3,600 revolutions per minute so that the impeller shaft of the final stage rotates at a speed of up to 60,000 revolutions per minute. This speed represents a gear ratio of approximately 17:1 which is as high as can be practicably obtained at present with this type of gearing. When such an arrangement of gearing is used with a standard British 2-pole 50 Hz motor which rotates at 3,000 revolutions per minute the maximum final compressor stage impeller shaft speed is limited by present day gearing to 50,000 revolutions per minute.

As the impeller speed increases so does the pressure ratio increase at which a centrifugal compressor stage of a particular flow capacity operates efficiently. Thus it may be necessary to employ more stages of compression in areas of 50 Hz electrical supply than in areas of 60 Hz electrical supply for comparable sizes of compressor operating at the same discharge pressure and using the bull gear arrangement. Alternatively, it will be appreciated that this feature can restrict the range of compressor sizes that may be utilized in areas of 50 Hz electrical supply compared with areas of 60 Hz electrical supply.

It also follows that an arrangement of gearing which allows higher overall gear ratios can reduce the number of stages required for normally used discharge pressures in areas of both 50 Hz and 60 Hz electrical supply.

Any standard design of integrally geared centrifugal compressor will require different arrangements of bull gearing according to the frequency of the electrical supply in the area where it is used which determines the drive motor running speed.

Furthermore, bull gear arrangements also require a large diameter driving gear in the order of 27 inches–30 feet diameter which results in a pitch line velocity of the gear teeth higher than 25,000 feet per minute and sometimes in excess of 30,000 feet per minute at which speeds the gears need to be very accurately machined with gear tooth profiles specifically adapted to suit each individual combination of gear load and speed. A further disadvantage of this arrangement has been the design and provision of suitable bearings for the high speed compressor shafts. Rolling contact bearings are generally beyond their range of suitable application and the use of plain journal bearings has generally resulted in vibration problems through oil film instability when the impeller shafts are running unloaded at normal operational speeds. This has lead to the use of relatively complicated and expensive tilting pad or special profile journal bearings.

SUMMARY OF THE INVENTION

According to the invention there is provided a centrifugal compressor having one or more stages, and a gear train for driving the impeller shaft of the, or each, stage, which gear train includes a plurality of meshing parallel shaft gears comprising two input gears either of which can receive drive from a prime mover, the ratio of the number of teeth of the input gears being such that the relative shaft speeds of the input gears are $5n$: 6N where $n$ is 1 or 2 and N is 1 or 2.

This arrangement permits the use of ratios of the shaft speeds of the input gears 5:6, 5:12, 10:6 or 10:12. The rotational speeds of the impeller shafts will be the same either when using a ratio of 5:6 and when one of the input gears receives drive from a 2-pole 50 Hz motor or when the other of the input gears receives a drive from a 2-pole 60Hz motor; or when using a ratio of 5:12 and when one of the input gears receives drive from a 2-pole 50Hz motor or when the other input gear receives drive from a 4-pole 60Hz motor; or when using a ratio of 10:6 when one input gear receives drive from a 4-pole 50Hz motor or when the other input gear receives drive from a 2-pole 60 Hz motor; or when using a ratio of 10:12 and when one input gear receives drive from a 4-pole 50Hz motor or when the other input gear receives drive from a 4-pole 60Hz motor.

Said input gears may mesh with one another, at least one of the input gears being also in mesh with a single further gear which, in use, drives the impeller shaft of a stage of the compressor, the ratio of the number of teeth of the input gears being 5n:6N.

There may also be provided an epicyclic gear train having an input to receive from a prime mover and an output which can be connected to drive either one of said input gears.

The gear train may be such that at least one of said input gears in use is driven directly by the output of a steam turbine.

It will be appreciated that such an arrangement will permit the use of either a 50 Hz or 60 Hz electric motor to drive the impeller shafts when used in conjunction with an epicyclic gear train or a turbine when used to drive said one of the input gears directly.

The input gears may have unobstructed splined bores to receive drive from a splined drive shaft.

DESCRIPTION OF THE PREFERRED EMBODIMENT

Figure 1:
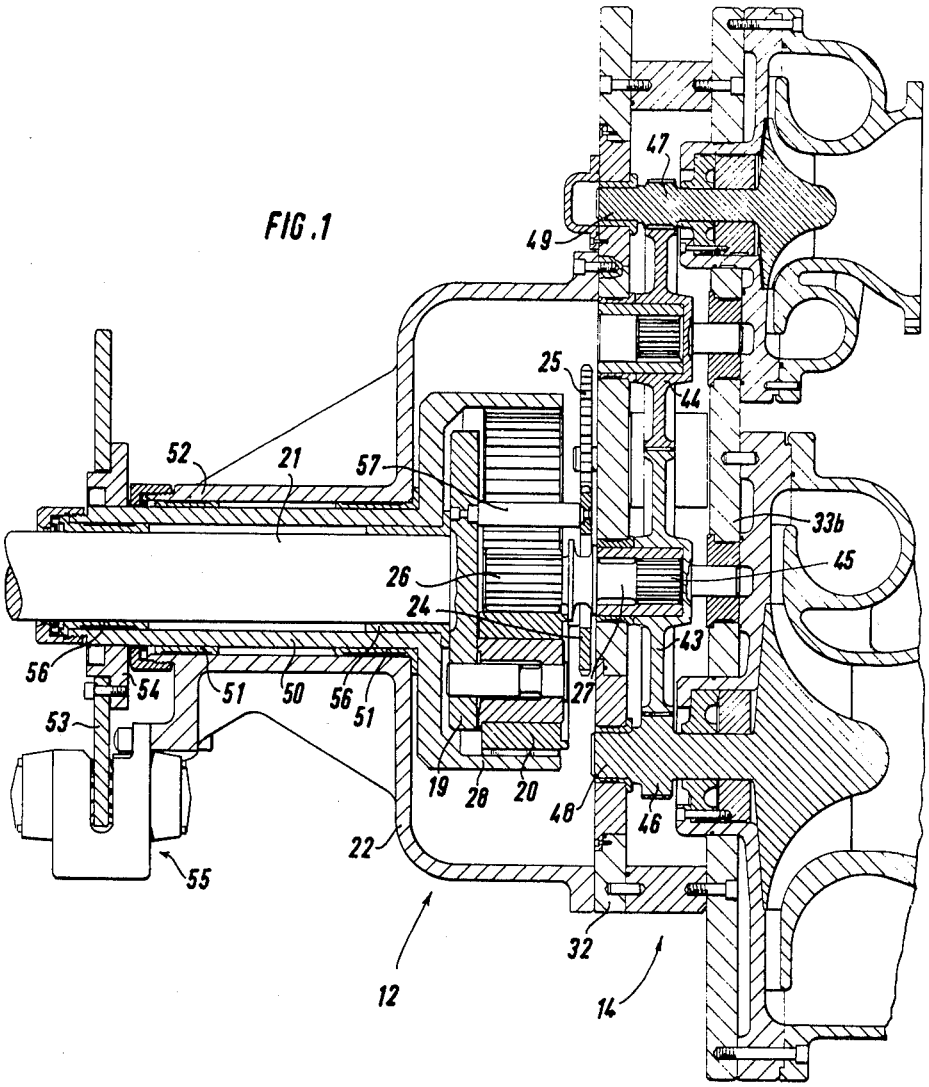
FIG. 1 is a plan view in section of a gear box of a compressor unit according to the invention.

Referring to the drawings, the two stage compressor unit is mounted on a base plate 10 (FIG.2) and comprises a 4-pole 50Hz electric motor 11 which rotates at 1,470 revolutions per minute. The motor drives an input to an epicyclic gear train 12 through a low speed coupling 13. The output of the epicyclic train 12 drives a series of parallel shaft speed increasing gears 14 as described in greater detail below with reference to FIG. 1. The gears 14 increase the speed of the output shaft of the epicyclic train to the required speeds of the impeller shafts of the first and second stage compressors 15 and 16 respectively. A water-cooled intercooler 17 and an aftercooler 18 are also located on the base plate 10.

Figure 2:
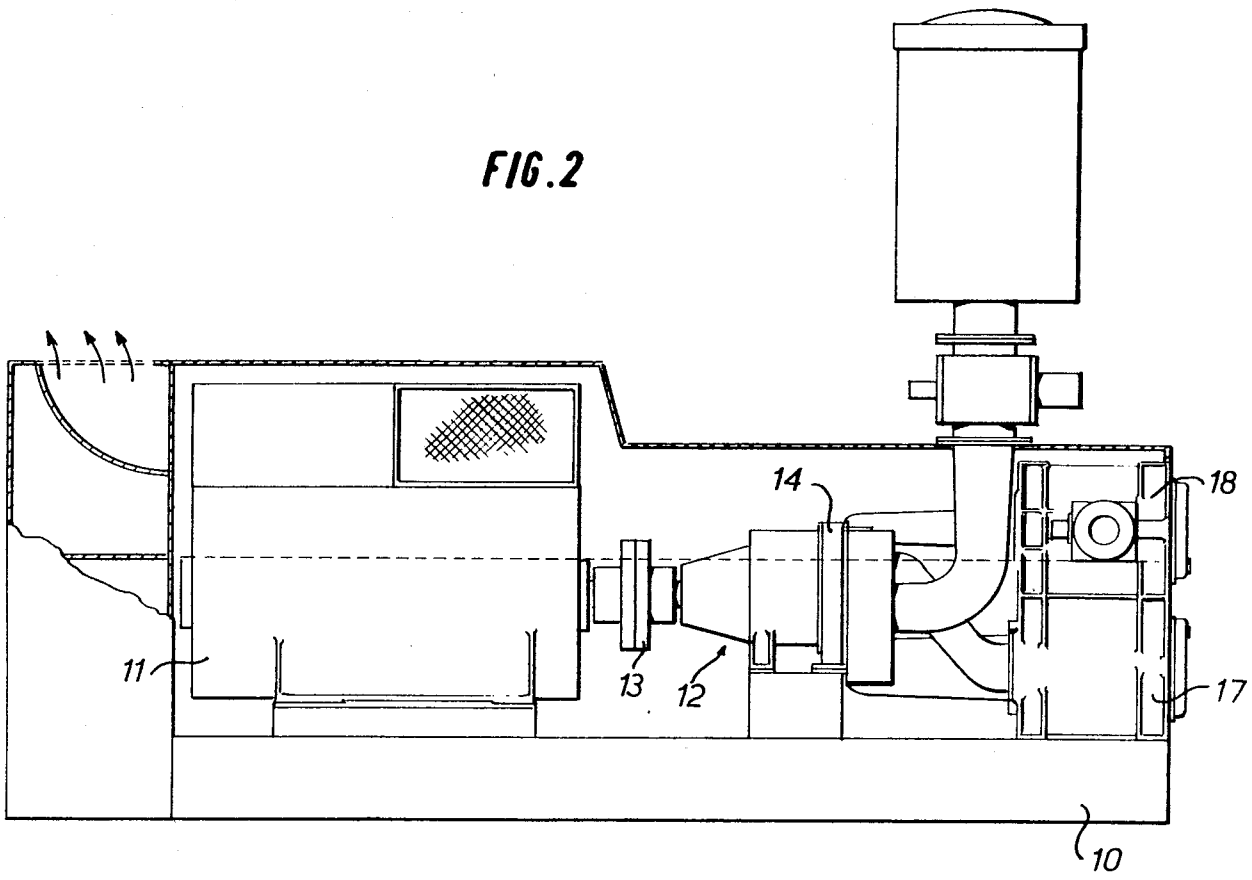
FIG. 2 is a side view of a two-stage compressor unit according to the invention.
Figure 3:
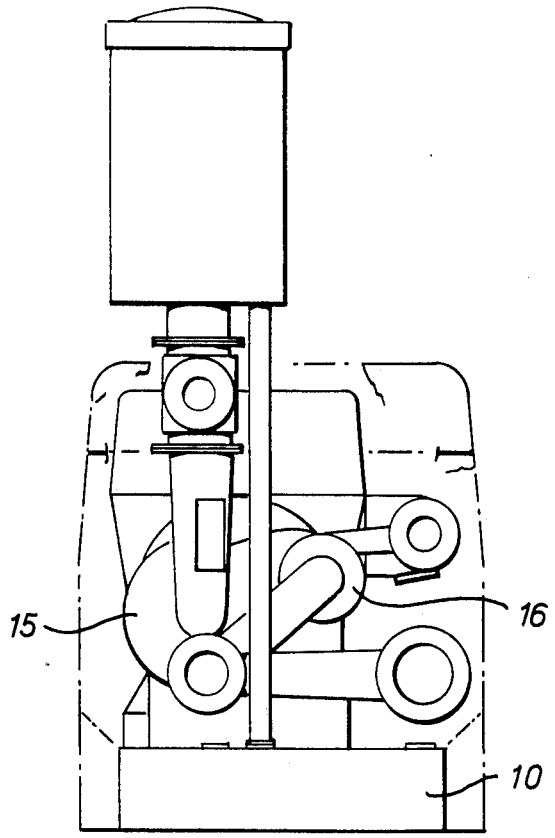
FIG. 3 is an end view of the compressor unit shown in FIG. 2 without the intercooler and aftercooler.

Referring now specifically to FIG. 1 the epicyclic gear train indicated generally by the numeral 12 comprises a ring gear 28, a sun gear 26 and a planet carrier 19 on one face of which three planet gears 20, only one of which is shown in FIG. 1, are rotatably mounted. The ring gear 28 has an integral tubular extension 50 which provides a layshaft rotatably mounted in plain bearings 51 provided in a tubular portion 52 of the casing 22. A disc 53 is secured to a hub 54 fixedly located on the portion of the layshift 50 projecting from the casing 22. One or more calipers 55 are provided on the casing 22 for braking the disc 53 to lock the ring gear 28 with respect to the casing 22.

The carrier 19 of the epicylic gear train has an integral stub shaft 21 which is rotatably mounted within the hollow layshaft 50 in bearings 56 provided therein. The stub shaft 21 projects from the layshaft 50 so that it can be readily driven via a low speed coupling 13 by the motor unit 11. An annular toothed member 24 is located opposite the carrier plate 19 on the side of the planet gears 20 remote from the plate 19, and is fixedly connected to the plate 19 by rod members 57 (one of which is shown in FIG. 1) each fixed at its ends to the member 24 and the plate 19 respectively. A gear 25 meshes with the member 24 and is connected to drive an oil pump for a purpose described below. The sun gear 26 is provided at one end of an output shaft 27 which extends through the central aperture in the annular member 24. The output shaft 27 drives the speed increasing gear train 14 as described below.

The speed increasing gear train comprises two intermeshing input gears 43 and 44 rotatably mounted in mesh with one another between end walls 32 and **33*b* of the casing for that gear train. The gears 43 and 44 are internally splined so that the splined end portion 45 of the output shaft 27 of the epicyclic gear train can be drivably connected with either one of the gears 43 and 44 as required. Further gears 46 and 47 are provided on shafts 48 and 49 respectively which are parallel to one another and project from the end wall 33*b* for driving respectively the impellers of the two stages of the compressor, and are in mesh with the input gears 43 and 44 respectively. The gears 46 and 47 and their respective shafts 48 and 49** are formed integrally.

The ratio of the number of teeth on gear 43 and gear 44 is 6:5 so that it is possible to use a 50 Hz or a 60 Hz motor as required to drive the gear train since the shafts carrying gears 43 and 44 will rotate at the same speeds respectively to rotate gears 46 and 47 at their correct operating speeds when a 50 Hz 2-pole motor is used to drive the epicylic gear train and when shaft 27 drives gear 43, or when a 60 Hz 2-pole motor is used to drive the epicyclic gear train and when the shaft 27 drives gear 44, so that it is merely necessary to select the correct gear 43 or 44 to be driven by the shaft 27 in dependence upon whether a 50 Hz or a 60 Hz motor having the same number of poles is used. If motors having different numbers of poles are used or each motor has 4 poles the gear ratio of the input gears will be altered as described above.

Furthermore it is possible to drive such a gear train using a steam turbine in place of the epicyclic gear train since a steam turbine operating under economical power conditions might typically have an output speed of 10,000 revolutions per minute so that it can drive gear 43 directly. It will therefore be appreciated that the above described system according to the invention is more flexible than prior art systems which have been suitable for drive by an electric motor or a steam turbine but not both.

Although a two-stage compressor is described above it will be appreciated that the arrangement described can be useful for centrifugal compressors having any number of stages.

An advantage of the above described arrangement is that in machines below the 1500 H.P. category it allows higher running speeds from a given input speed than is possible with a single train parallel shaft arrangement with which it is difficult to provide optimum compressor speeds for stage pressure ratios above 2:1.

Thus the selected gearing makes possible a two stage compressor arrangement with both stages operating at the optimum speeds for a pressure ratio of approximately 3.0:1 for each stage. The much higher gear ratio available with the two train system allows the use of quieter and more acceptable 4-pole motor.

Furthermore the nature of the epicyclic first train allows the drive to be readily uncoupled for control purposes.

With the proposed gear arrangement it is possible to release the annulus system of the primary epicyclic gear train to unload the impeller shafts so that the high speed impeller shafts then rotate at a relatively low idling speed. Thus simple plain bearings may be used as they will always be loaded when running at full speed and so avoid the stability problems associated with light load high-speed running. Moreover, the impeller shafts can be offloaded without the need to stop and restart the main drive motor.

I claim:

1. In combination with an electrical motor means operating as a 2 pole or 4 pole in the range of 50 Hz to 60 Hz for driving a two-stage centrifugal compressor with said stages having parallel impeller shafts and a centrifugal impeller mounted on each shaft; a gear train for driving the impeller shafts which gear train includes gears mounted on each of the impeller shafts parallel to each other and intermeshing rotatably disposed input gears in mesh with the gears on the impeller shafts, either of said input gears being adapted to receive drive from said motor means, the ratio of the number of teeth of the input gears being such that the relative shaft speeds of the input gears are $5n : 6N$ where $n$ is 1 or 2 and N is 1 or 2 whereby the input gears will rotate at the same speeds whether a 2 pole or 4 pole 50 Hz or 2 pole or 4 pole 60 Hz motor means is being used so that the rotational speeds of the impeller shafts will be the same.

2. The invention claim 1 including an epicylic gear train having an input to receive drive from the motor means and an output which can be connected to drive either of said input gears.

3. The invention of in claim 1 wherein the gear train is such that at least one of said input gears in use is driven directly by the output of a steam turbine.

4. The invention of claim 1 wherein the input gears have unobstructed splined bores to receive drive from a splined drive shaft.

* * * * *